US011898825B2

(12) United States Patent
Wingert

(10) Patent No.: US 11,898,825 B2
(45) Date of Patent: Feb. 13, 2024

(54) DART CATCHING DEVICE

(71) Applicant: Chad S. Wingert, La Mirada, CA (US)

(72) Inventor: Chad S. Wingert, La Mirada, CA (US)

( * ) Notice: Subject to any disclaimer, the term of this patent is extended or adjusted under 35 U.S.C. 154(b) by 405 days.

(21) Appl. No.: 16/823,494

(22) Filed: Mar. 19, 2020

(65) Prior Publication Data

US 2021/0293517 A1 Sep. 23, 2021

(51) Int. Cl.
*F41J 3/00* (2006.01)

(52) U.S. Cl.
CPC ..... *F41J 3/0009* (2013.01)

(58) Field of Classification Search
CPC ..... A47B 96/027; F42B 39/007; F41J 3/0014–0019; F41J 3/0028
USPC ..... D6/574, 560, 567
See application file for complete search history.

(56) References Cited

U.S. PATENT DOCUMENTS

| | | | | |
|---|---|---|---|---|
| 2,074,850 | A * | 3/1937 | McCullough | F41J 3/0019 273/410 |
| 3,501,149 | A * | 3/1970 | Meyer | F41J 3/0028 273/407 |
| 3,790,173 | A | 2/1974 | Callaway | |
| D253,863 | S | 1/1980 | Kurtz | |
| 4,294,365 | A * | 10/1981 | Henderson | F42B 39/007 206/315.1 |
| 4,333,657 | A | 6/1982 | Jaworski | |
| D290,672 | S * | 7/1987 | Pearson | D6/552 |
| D299,687 | S * | 2/1989 | Handler | D6/574 |
| 4,824,120 | A * | 4/1989 | Wang | F41J 1/00 273/348.5 |
| 4,919,436 | A * | 4/1990 | Buselli | A63F 9/0208 273/348.4 |
| 4,948,148 | A * | 8/1990 | Danielson | F41J 3/02 116/222 |
| 4,971,333 | A * | 11/1990 | Buselli | A63F 9/0208 273/348.4 |
| D328,726 | S | 8/1992 | Beall | |
| 5,496,039 | A | 3/1996 | Zammuto | |
| 6,045,132 | A | 4/2000 | Giegerich | |
| 7,419,163 | B2 | 9/2008 | Hartwig | |
| 8,636,153 | B1 * | 1/2014 | Dattilo | F41J 3/0028 211/85.7 |

(Continued)

FOREIGN PATENT DOCUMENTS

| | | | | |
|---|---|---|---|---|
| CN | 203132436 U | * | 8/2013 | |
| GB | 481943 A | * | 3/1938 | F41J 3/0095 |
| GB | 633131 A | * | 12/1949 | F41J 5/20 |

OTHER PUBLICATIONS

M&M Timber, "Retail Staging & Display Stands" Leaflet, Edition 2, published Jan. 2020, "Half Octagonal Table", https://mmtimber.co.uk/wp-content/uploads/2020/01/MM-Timber-Plant-Staging-Leaflet-A5-12pp-WEB.pdf (Year: 2020).*

(Continued)

*Primary Examiner* — Laura Davison

(57) ABSTRACT

A dart catching device for catching darts that fail to adhere to a dartboard includes a tray, which is mountable to a vertical surface upon which a dartboard is positioned. The tray is mounted below the dartboard and extends substantially perpendicularly from the vertical surface. The tray can catch a dart that is thrown at the dartboard, but which fails to adhere to the dartboard. The device can prevent damage to the dart that might occur should the dart drop to a horizontal surface beneath the dartboard.

12 Claims, 5 Drawing Sheets

(56) References Cited

U.S. PATENT DOCUMENTS

| | | | | |
|---|---|---|---|---|
| D750,909 | S * | 3/2016 | Hickman | D6/310 |
| 10,087,612 | B2 * | 10/2018 | Brown | E03D 13/005 |
| 2002/0175470 | A1 * | 11/2002 | Silva | F41J 3/00 273/408 |
| 2009/0184474 | A1 * | 7/2009 | Chang | F41J 5/056 273/374 |

OTHER PUBLICATIONS

Page Furnishers, "Half Octagonal Table", http://pagefurn.com.au/productCatalog.aspx?CatID=8&SubCatID=28&ProductID=100, archived by Internet Archive on Feb. 16, 2017 (Year: 2017).*

Kone Mei, "I Transformed Pallets Into a Functional Wall Decoration", www.boredpanda.com/i-transformed-pallets-into-a-functional-wall-decoration/, published Jan. 12, 2017 (Year: 2017).*

* cited by examiner

DART CATCHING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to catching devices and more particularly pertains to a new catching device for catching darts that fail to adhere to a dartboard.

(2) Description of Related Art Including Information Disclosed Under 37 CFR 1.97 and 1.98

The prior art relates to catching devices. Prior art devices directed to catching non-adhering darts may comprise a framed net that is positioned below a dart board.

BRIEF SUMMARY OF THE INVENTION

An embodiment of the disclosure meets the needs presented above by generally comprising a tray, which is configured to be mountable to a vertical surface upon which a dartboard is positioned. The tray is mounted below the dartboard and extends substantially perpendicularly from the vertical surface. The tray thus is configured to catch a dart that is thrown at the dartboard, but which fails to adhere to the dartboard. The device can prevent damage to the dart that might occur should the dart drop to a horizontal surface beneath the dartboard.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
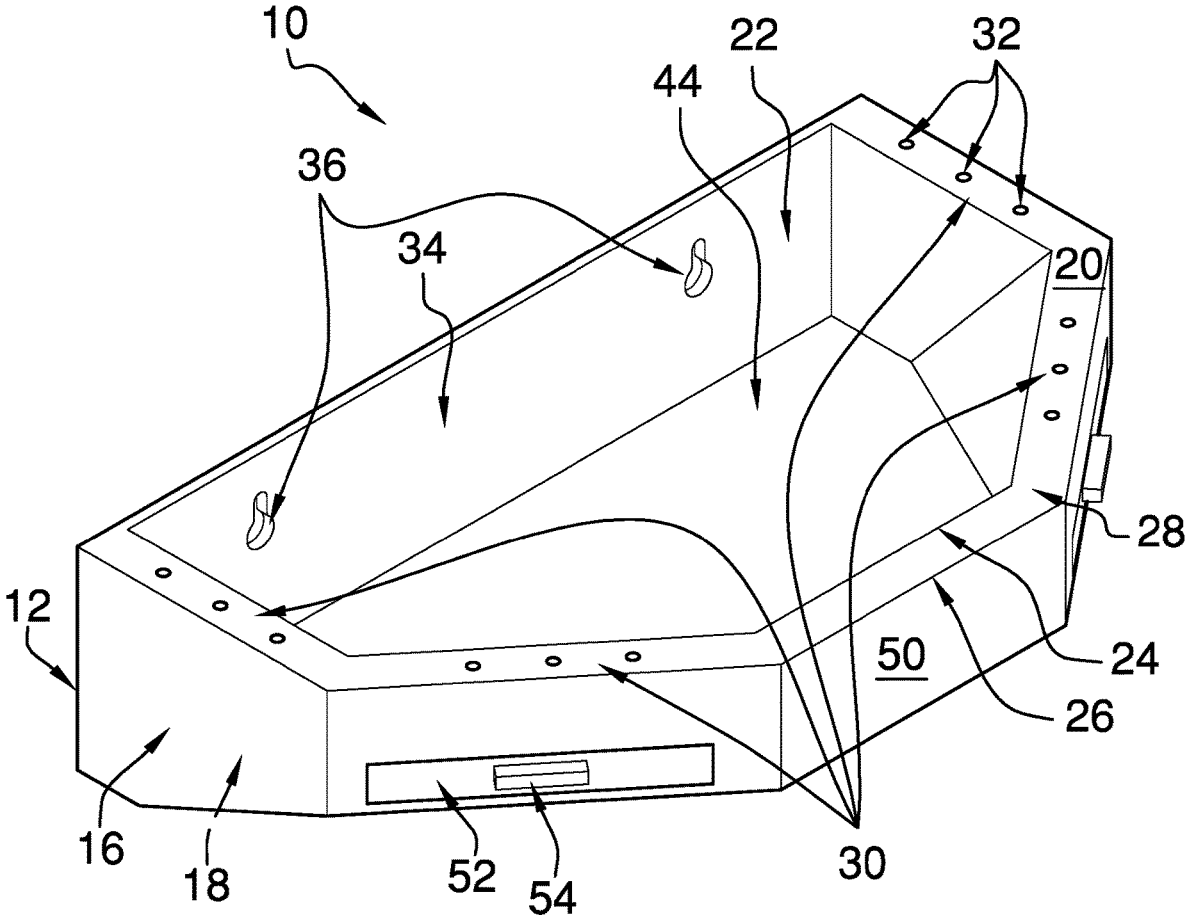
FIG. 1 is an isometric perspective view of a dart catching device according to an embodiment of the disclosure.

With reference now to the drawings, and in particular to FIGS. 1 through 6 thereof, a new catching device embodying the principles and concepts of an embodiment of the disclosure and generally designated by the reference numeral 10 will be described.

As best illustrated in FIGS. 1 through 6, the dart catching device 10 generally comprises a tray 12, which is configured to be mountable to a vertical surface upon which a dartboard 14 is positioned. The tray 12 is mounted below the dartboard 14 and extends substantially perpendicularly from the vertical surface. The tray 12 thus is configured to catch a dart that is thrown at the dartboard 14, but which fails to adhere to the dartboard 14. The device 10 can prevent damage to the dart that might occur should the dart drop to a floor surface beneath the dartboard 14. It also is more convenient to a user to collect an errant dart from the tray 12 than to retrieve it from the floor surface.

The tray 12 comprises a housing 16, which defines an interior space 18. The housing 16 has an upper face 20, which is concavely shaped to define a recess 22, as shown in FIG. 1. The recess 22 is configured to catch the dart thrown at the dartboard 14, but which failed to adhere to the dartboard 14.

Figure 5:
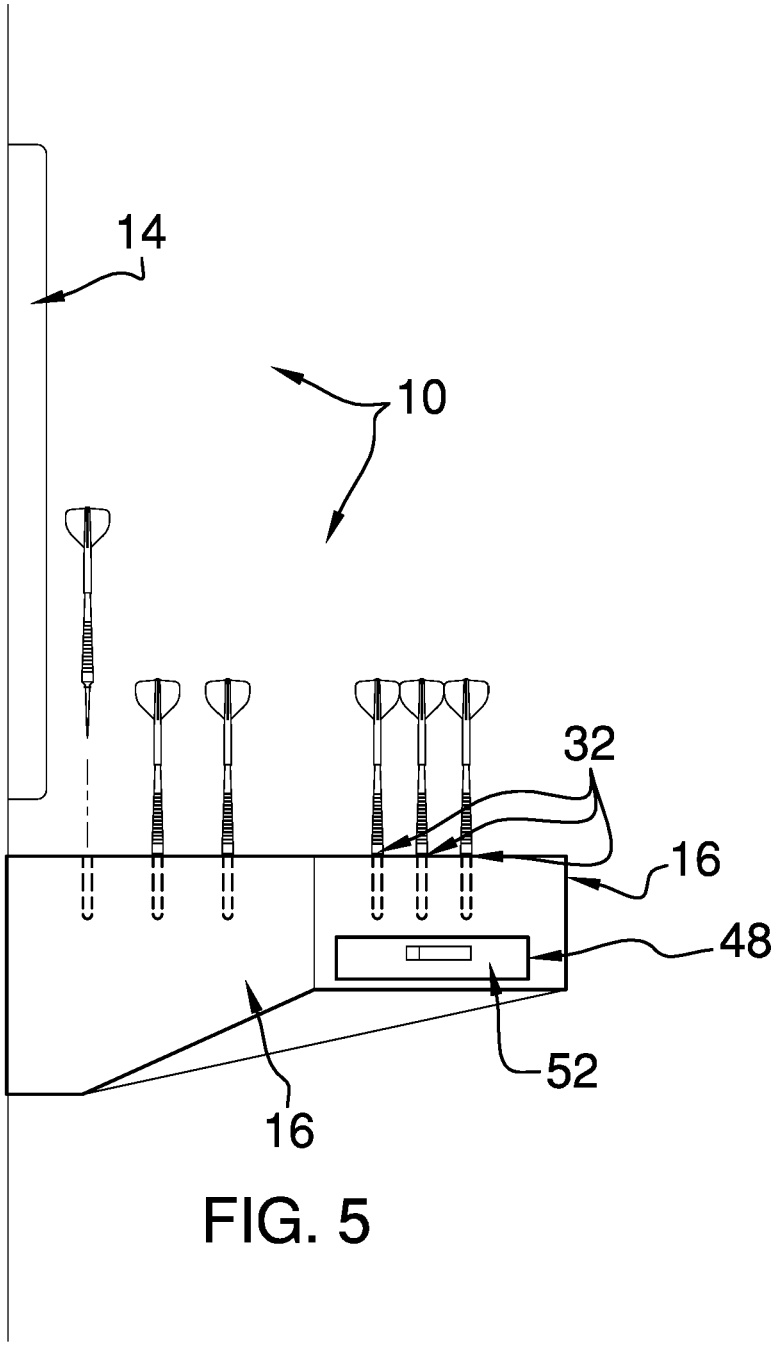
FIG. 5 is a side view of an embodiment of the disclosure.
Figure 6:
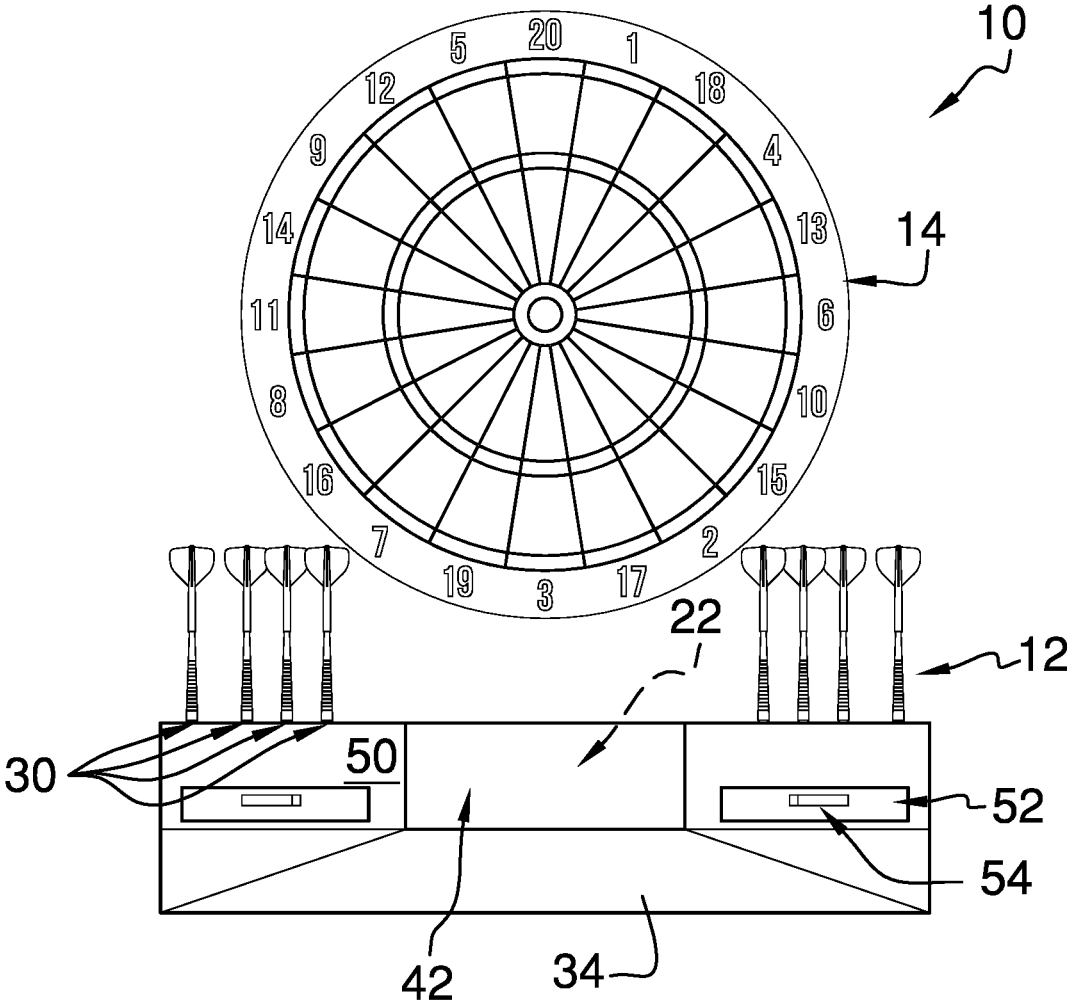
FIG. 6 is an in-use view of an embodiment of the disclosure.

The recess 22 has an upper perimeter 24. The upper face 20 has a circumference 26. The upper perimeter 24 and the circumference 26 define a rim 28, which has a plurality of holes 30 positioned therein, each of which opens into the interior space 18, as shown in FIG. 5. Each hole 30 is configured to insert a tip of a respective dart to removably engage the respective dart to the housing 16. The holes 30 may be positioned in sets 32 comprising three holes 30 each, with each set 32 of holes 30 being configured to stow a set of three darts.

Figure 2:
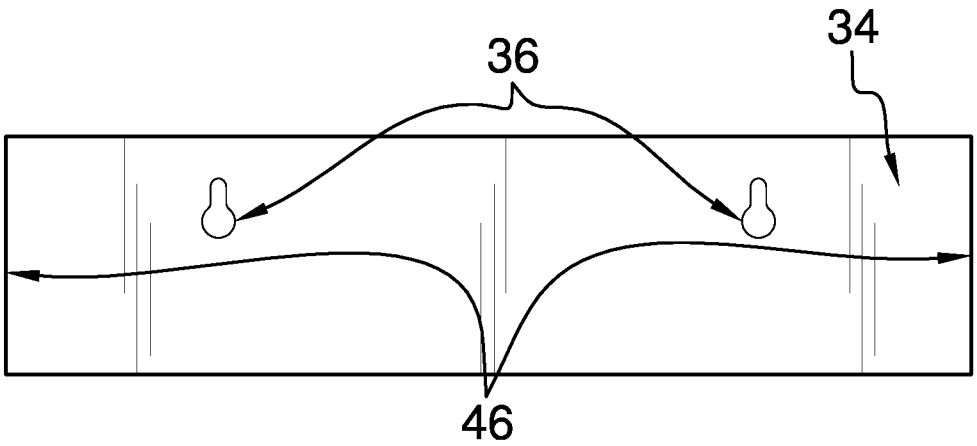
FIG. 2 is a back view of an embodiment of the disclosure.

The housing 16 comprises a back plate 34. The back plate 34 has a plurality of apertures 36 positioned therein, as shown in FIG. 2. Each aperture 36 opens into the recess 22, as shown in FIG. 1. Each aperture 36 is configured for insertion of a respective fastener (not shown), such as a screw, to mount the housing 16 to the vertical surface. The present invention anticipates other mounting means for attaching the housing 16 to the vertical surface, such as, but not limited to, adhesives, brackets, and the like. The present invention also anticipates the dartboard 14 being integral to the back plate 34.

The housing 16 also comprises a pair of side sections 38, a pair of medial sections 40, a front section 42, and a bottom section 44. Each side section 38 is coupled to and extends perpendicularly from a respective opposed end 46 of the back plate 34. Each medial section 40 extends transversely from a respective side section 38 distal from the back plate 34. The front section 42 is coupled to and extends between the medial sections 40, distal from the back plate 34, so that the housing 16 has a partial octagonal shape when viewed from the upper face 20. The bottom section 44 is coupled to and extends between the back plate 34, the side sections 38, the medial sections 40, and the front section 42. The bottom section 44 is substantially parallel planar to the upper face 20 of the housing 16. The present invention also anticipates the housing having other shapes when viewed from the upper face 20, such as, but not limited to, semicircular, half-oval, and the like.

Figure 3:
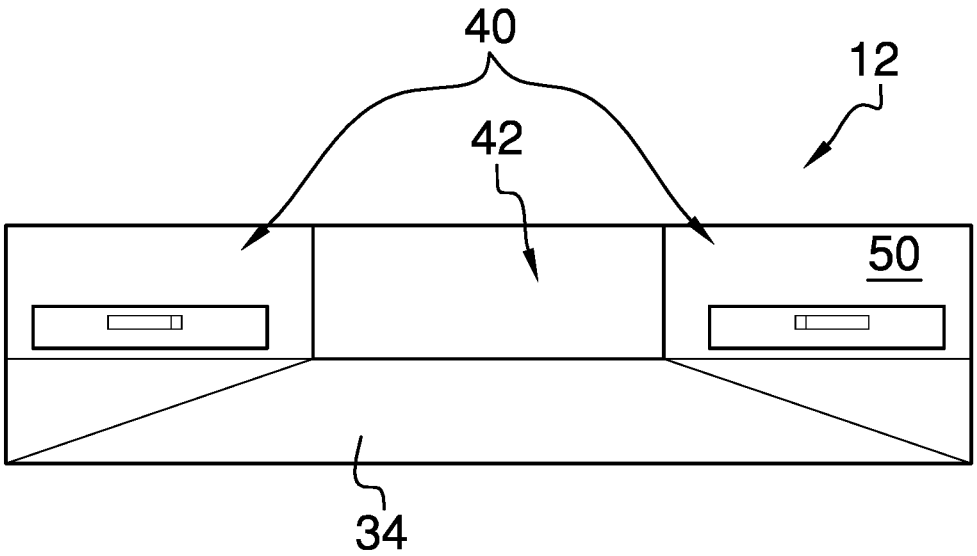
FIG. 3 is a front view of an embodiment of the disclosure.

As shown in FIG. 3, the back plate 34 may be dimensionally taller than the front section 42 and the medial sections 40 of the housing 16. Each side section 38 tapers from the respective opposed end 46 of the back plate 34 to an associated medial section 40, as shown in FIG. 5. The pair of side sections 38 is positioned to brace the housing 16 relative to the vertical surface.

Figure 4:
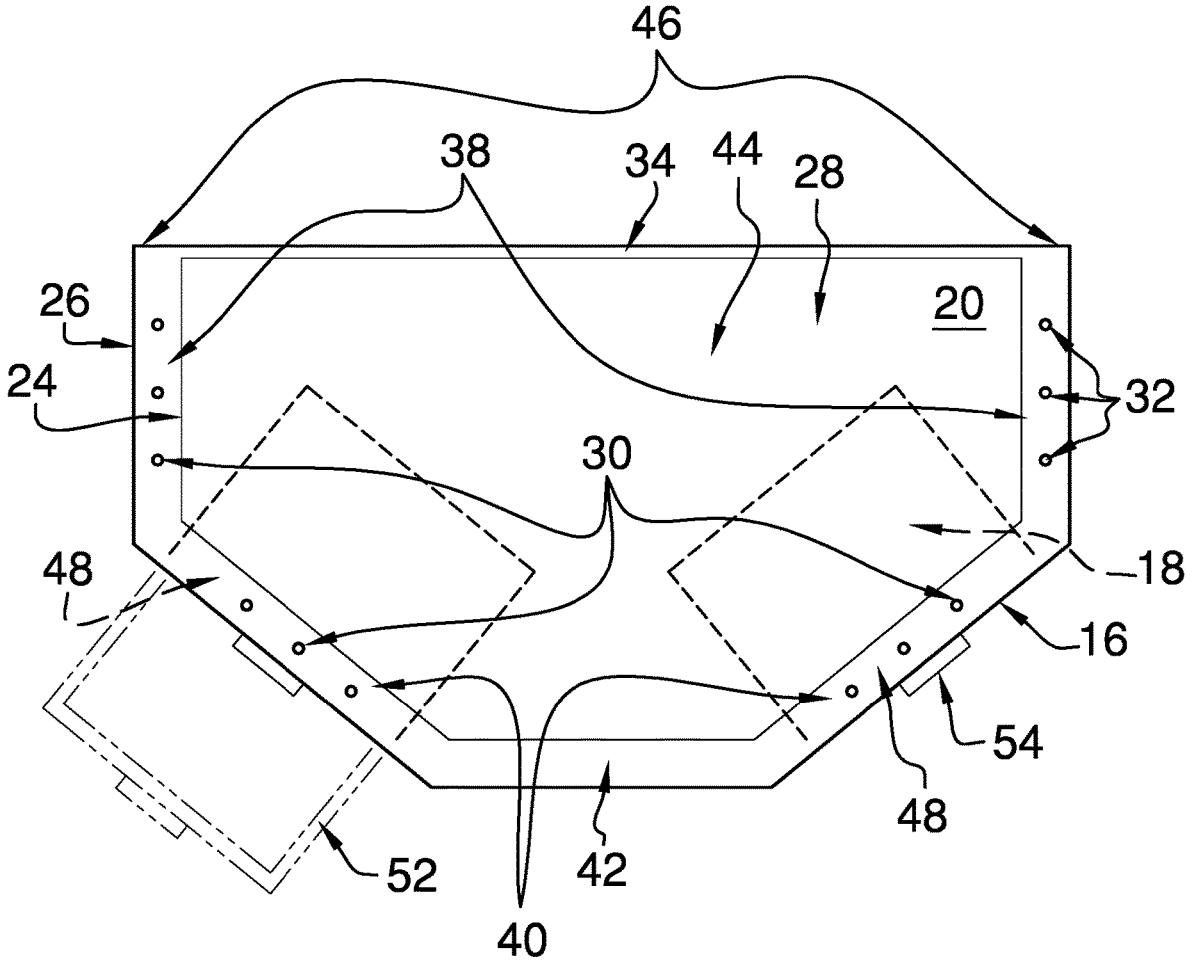
FIG. 4 is a top view of an embodiment of the disclosure.

The housing 16 has a slot 48 positioned in an outer face 50 thereof, which opens into the interior space 18. A drawer 52 is positioned in and is selectively extendible from the slot 48, as shown in FIG. 4. The drawer 52 is configured to stow an article, such as a darts or parts thereof. A knob 54 is coupled to the drawer 52 and is configured to be grasped in digits of a hand of the user to extend the drawer 52 from the slot 48.

In use, the housing 16 is mounted to the vertical surface, below the dartboard 14, by screwing a screw though each of the apertures 36 in the back plate 34. The recess 22 in the upper face 20 of the housing 16 is configured to catch the dart thrown at the dartboard 14, but which failed to adhere to the dartboard 14. Darts not being used can be stowed by inserting the tip of each dart into a respective hole 30 in the rim 28. The drawers 52 are available to stow darts and parts thereof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A dart catching device comprising:

a tray configured to be mountable to a vertical surface upon which a dartboard is positioned, such that the tray is positioned below the dartboard and extends substantially perpendicularly from the vertical surface, wherein the tray is configured for catching a dart thrown at the dartboard, but which fails to adhere to the dartboard;

a housing defining an interior space, the housing having an upper face, the upper face being concavely shaped defining a recess, wherein the recess is configured for catching the dart thrown at the dartboard, but which failed to adhere to the dartboard;

wherein the housing comprises:

a pair of side sections, each side section being coupled to and extending perpendicularly from a respective opposed end of a back plate;

a pair of medial sections, each medial section extending transversely from a respective side section distal from the back plate;

a front section coupled to and extending between the medial sections distal from the back plate, such that the housing has a partial octagonal shape when viewed from the upper face, the back plate of the housing having a plurality of apertures positioned therein and opening into the recess, wherein each aperture is configured for insertion of a respective fastener for mounting the housing to the vertical surface; and the housing further including a bottom section coupled to and extending between the back plate, the side sections, the medial sections, and the front section, such that the bottom section is substantially parallel planar to the upper face of the housing.

2. The dart catching device of claim 1, wherein:

the recess has an upper perimeter; and the upper face has a circumference, the upper perimeter and the circumference defining a rim, the rim having a plurality of holes positioned therein and opening into the interior space, wherein each hole is configured for inserting a tip of a respective dart for removably engaging the respective dart to the housing.

3. The dart catching device of claim 1, wherein:

the back plate is dimensionally taller than the front section and the medial sections of the housing; and each side section tapers from the respective opposed end of the back plate to an associated medial section, such that the pair of side sections is positioned for bracing the housing relative to the vertical surface.

4. The dart catching device of claim 1, further including:

the housing having a slot positioned in an outer face thereof and opening into the interior space; and a drawer positioned in and selectively extendible from the slot, wherein the drawer is configured for stowing an article.

5. The dart catching device of claim 4, further including a knob coupled to the drawer, wherein the knob is configured for grasping in digits of a hand of a user for extending the drawer from the slot.

6. A dartboard and dart catching device combination comprising:

a dartboard configured to be mountable to a vertical surface;

a tray configured to be mountable to the vertical surface, such that the tray is positioned below the dartboard and extends substantially perpendicularly from the vertical surface, wherein the tray is configured for catching a dart thrown at the dartboard, but which fails to adhere to the dartboard, wherein the tray comprises a housing defining an interior space, the housing having an upper face, the upper face being concavely shaped defining a recess, wherein the recess is configured for catching the dart thrown at the dartboard, but which failed to adhere to the dartboard, wherein the housing comprises a back plate, the back plate having a plurality of apertures positioned therein and opening into the recess, wherein each aperture is configured for insertion of a respective fastener for mounting the housing to the vertical surface; and wherein the housing comprising:

a pair of side sections, each side section being coupled to and extending perpendicularly from a respective opposed end of the back plate;

a pair of medial sections, each medial section extending transversely from a respective side section distal from the back plate;

a front section coupled to and extending between the medial sections distal from the back plate, such that the housing has a partial octagonal shape when viewed from the upper face; and a bottom section coupled to and extending between the back plate, the side sections, the medial sections, and the front section, such that the bottom section is substantially parallel planar to the upper face of the housing.

7. The dartboard and dart catching device combination of claim 6, wherein:

the recess has an upper perimeter; and the upper face has a circumference, the upper perimeter and the circumference defining a rim, the rim having a plurality of holes positioned therein and opening into the interior space, wherein each hole is configured for inserting a tip of a respective dart for removably engaging the respective dart to the housing.

8. The dartboard and dart catching device combination of claim 6, wherein:

the back plate is dimensionally taller than the front section and the medial sections of the housing; and each side section tapers from the respective opposed end of the back plate to an associated medial section, such that the pair of side sections is positioned for bracing the housing relative to the vertical surface.

9. The dartboard and dart catching device combination of claim 6, further including:

the housing having a slot positioned in an outer face thereof and opening into the interior space; and a drawer positioned in and selectively extendible the slot, wherein the drawer is configured for stowing an article.

10. The dartboard and dart catching device combination of claim 9, further including a knob coupled to the drawer, wherein the knob is configured for grasping in digits of a hand of a user for extending the drawer from the slot.

11. The dartboard and dart catching device combination of claim 6, wherein the dartboard is integral to the back plate.

12. A dart catching device comprising:

a tray configured to be mountable to a vertical surface upon which a dartboard is positioned, such that the tray is positioned below the dartboard and extends substantially perpendicularly from the vertical surface, wherein the tray is configured for catching a dart thrown at the dartboard, but which fails to adhere to the dartboard;

the tray comprising a housing defining an interior space, the housing having an upper face, the upper face being concavely shaped defining a recess, wherein the recess is configured for catching the dart thrown at the dartboard, but which failed to adhere to the dartboard, the recess having an upper perimeter, the upper face having a circumference, the upper perimeter and the circumference defining a rim, the rim having a plurality of holes positioned therein and opening into the interior space, wherein each hole is configured for inserting a tip of a respective dart for removably engaging the respective dart to the housing;

the housing comprising:

a back plate, the back plate having a plurality of apertures positioned therein and opening into the recess, wherein each aperture is configured for insertion of a respective fastener for mounting the housing to the vertical surface, a pair of side sections, each side section being coupled to and extending perpendicularly from a respective opposed end of the back plate, a pair of medial sections, each medial section extending transversely from a respective side section distal from the back plate, a front section coupled to and extending between the medial sections distal from the back plate, such that the housing has a partial octagonal shape when viewed from the upper face, and a bottom section coupled to and extending between the back plate, the side sections, the medial sections, and the front section, such that the bottom section is substantially parallel planar to the upper face of the housing;

the back plate being dimensionally taller than the front section and the medial sections of the housing, each side section tapering from the respective opposed end of the back plate to an associated medial section such that the pair of side sections is positioned for bracing the housing relative to the vertical surface;

the housing having a slot positioned in an outer face thereof and opening into the interior space;

a drawer positioned in and selectively extendible the slot, wherein the drawer is configured for stowing an article; and a knob coupled to the drawer, wherein the knob is configured for grasping in digits of a hand of a user for extending the drawer from the slot.

* * * * *